US010665954B2

(12) United States Patent
Sasaki et al.

(10) Patent No.: US 10,665,954 B2
(45) Date of Patent: May 26, 2020

(54) LEAKY-WAVE ANTENNA

(71) Applicant: Denki Kogyo Company, Limited, Tokyo (JP)

(72) Inventors: Takayoshi Sasaki, Tokyo (JP); Keisuke Sato, Tokyo (JP); Ichiro Oshima, Tokyo (JP); Naobumi Michishita, Kanagawa (JP); Keizo Cho, Kanagawa (JP)

(73) Assignee: Denki Kogyo Company, Limited (JP)

( * ) Notice: Subject to any disclaimer, the term of this patent is extended or adjusted under 35 U.S.C. 154(b) by 0 days.

(21) Appl. No.: 16/349,876

(22) PCT Filed: May 14, 2018

(86) PCT No.: PCT/JP2018/018522

§ 371 (c)(1),
(2) Date: May 14, 2019

(87) PCT Pub. No.: WO2019/039004

PCT Pub. Date: Feb. 28, 2019

(65) Prior Publication Data

US 2019/0273324 A1 Sep. 5, 2019

(30) Foreign Application Priority Data

Aug. 22, 2017 (JP) ..... 2017-159386

(51) Int. Cl.
*H01Q 15/24* (2006.01)
*H01Q 13/26* (2006.01)
(Continued)

(52) U.S. Cl.
CPC ..... *H01Q 15/24* (2013.01); *H01P 3/00* (2013.01); *H01Q 1/48* (2013.01); *H01Q 1/50* (2013.01);
(Continued)

(58) Field of Classification Search
CPC ..... H01Q 13/20; H01Q 13/26; H01Q 15/24; H01Q 21/08; H01Q 21/24; H01Q 21/245
See application file for complete search history.

(56) References Cited

U.S. PATENT DOCUMENTS 10,367,268 B2 * 7/2019 Oshima ..... H01Q 21/26
2009/0245146 A1 * 10/2009 Gummalla ..... H01Q 1/2283 370/281
(Continued)

FOREIGN PATENT DOCUMENTS

CN 105914473 A 8/2016
CN 105990688 A 10/2016
(Continued)

OTHER PUBLICATIONS

Chinese Search Report for Publication 201880004398.2 dated Oct. 8, 2019, 3 pages.
(Continued)

*Primary Examiner* — Dameon E Levi
*Assistant Examiner* — Jennifer F Hu
(74) *Attorney, Agent, or Firm* — Lerner, David, Littenberg, Krumholz & Mentlik, LLP

(57) ABSTRACT

The present invention realizes a thin dual-polarized leaky-wave antenna which uses a CRLH (Composite Right/Left Handed) transmission line and capable of obtaining a high tilt angle in a directivity in the vertical plane while suppressing cross polarization and side lobe at a target operation frequency.

Specifically, the present invention provides a leaky-wave antenna including a dielectric substrate, a ground surface formed on a bottom surface of the dielectric substrate, a ground unit formed on a top surface of the dielectric substrate, and a CRLH (Composite Right/Left Handed) transmission line which is arranged adjacent to the ground unit and formed on a top surface of the dielectric substrate and uses a coplanar transmission line with a ground, in which a series capacitor ($C_L$) and a parallel inductor ($L_L$) constituting the CRLH transmission line are formed on a top surface of the dielectric substrate.

6 Claims, 9 Drawing Sheets

(51) Int. Cl.

| | |
|---|---|
| ***H01Q 13/20*** | (2006.01) |
| ***H01P 3/00*** | (2006.01) |
| ***H01Q 21/24*** | (2006.01) |
| ***H01Q 21/08*** | (2006.01) |
| ***H01Q 1/48*** | (2006.01) |
| ***H01Q 1/50*** | (2006.01) |

(52) U.S. Cl.
CPC ..... *H01Q 13/20* (2013.01); *H01Q 13/26* (2013.01); *H01Q 21/08* (2013.01); *H01Q 21/24* (2013.01)

(56) References Cited

U.S. PATENT DOCUMENTS

| | | | | |
|---|---|---|---|---|
| 2010/0019863 | A1* | 1/2010 | Iguchi | H01P 1/215 333/185 |
| 2011/0148727 | A1* | 6/2011 | Chang | H01Q 13/20 343/777 |
| 2018/0040961 | A1 | 2/2018 | Oshima et al. | |

FOREIGN PATENT DOCUMENTS

| | | | |
|---|---|---|---|
| CN | 107534221 | A | 1/2018 |
| JP | 200854146 | A | 3/2008 |
| JP | 201658839 | A | 4/2016 |
| WO | 2016132499 | A1 | 8/2016 |

OTHER PUBLICATIONS

Abielmona, S. et al., "CRLH LWA with polarization diversity using equalized common and differential modes", Antennas and Propagation Society International Symposium (APSURSI), 2012 IEEE, Date of Conference Jul. 8, 2012, 3 pages.

International Search Report for Application No. PCT/JP2018/018522 dated Jul. 17, 2018.

Mehdipour, A. et al., "Leaky-Wave Antennas Using Negative-Refractive-Index Transmission-Line Metamaterial Supercells", IEEE Transactions on Antennas and Propagation, May 9, 2014, vol. 62, No. 8, pp. 3929-3942.

* cited by examiner

LEAKY-WAVE ANTENNA

CROSS REFERENCE TO RELATED APPLICATIONS

The present application is a national phase entry under 35 U.S.C. § 371 of International Application No. PCT/JP2018/018522 filed May 14, 2018, published in Japanese, which claims the benefit of and priority to Japanese Patent Application No. 2017-159386, filed Aug. 22, 2017, the entire disclosures of which are hereby incorporated by reference herein.

FIELD OF THE INVENTION

The present invention relates to a thin antenna constituted by using a metamaterial technique, and particularly relates to a leaky-wave antenna suitable for a base station antenna for mobile communications.

BACKGROUND ART

In recent years, communication technology for mobile terminals such as cell phones and smart phones has shown remarkable progress. The number of users of mobile communication terminals has been increasing every year, and thus the amount of data communication by individual users has been increasing. Accordingly, improvement of efficiency of frequency use and the like are required for base station antennas for mobile communications.

For a base station antenna for such mobile communications, dual-polarized antennas (such antennas as using vertical and horizontal polarizations or +45 degree and −45 degree polarizations) have become the mainstream. Dual-polarized antennas are capable of performing polarization diversity or cross polarization MIMO (Multi-Input Multi-Output).

On the other hand, due to communication traffic shortages in urban areas and the like, antennas for small cells have been increasingly used, which cover an area smaller than the areas having been covered by conventional base station antennas so far (macrocells). Different from macrocell antennas that are usually placed on steel towers or on the rooftop of tall buildings, such small-cell antennas are assumed to be mounted on walls, rooftop, or the like of relatively short buildings. Such small-cell antennas are easily visibly recognized, and thus are desired to be reduced in size and made thinner from the viewpoint of preserving esthetic features of streets, such as consideration of urban landscapes and the like.

For a thin antenna, for example, Patent Document 1 discloses a planar antenna having a thin structure in which multiple CRLH (Composite Right/Left Handed) transmission lines are printed on a dielectric substrate. In Patent Document 1, the feeding phase to each CRLH transmission line can be changed, and it is thereby made possible to easily switch between polarized signals.

CITATION LIST

Patent Document

Patent Document 1: Japanese Patent Application Laid-Open No. 2016-58839

SUMMARY OF INVENTION

Technical Problem

The emission element described in Patent Document 1 has a structure in which the emission element becomes thicker for the thickness of a ground plate raising unit connected between the dielectric substrate and the ground plate because the dielectric substrate and the ground plate are configured separately from each other. Accordingly, it is difficult to reduce the weight of and thin the emission element to make the emission element less easily recognizable in mounting the antenna on walls of a building and the like.

In addition, the emission element of Patent Document 1 has a problem in that a part such as a ground plate raising unit is necessary, and thus, the number of types of constituent parts increases, and as a result, the configuration of the antenna becomes more complex, increasing costs.

Furthermore, in the emission element of Patent Document 1, the half-value angles for the vertical and horizontal polarizations are not identical to each other for the directivity in the horizontal plane. Accordingly, it is necessary to perform the cell design so that directivity can be implemented which is suitable for small cells at a mobile communication base station by decreasing the difference between the half-value angles between polarizations.

The present invention has been invented in consideration of the above-described circumstances, and provides a leaky-wave antenna which is capable of shared use of polarizations and requires a small number of parts and part types.

In addition, to achieve the directivity suitable for small cells, the present invention also provides a thin leaky-wave antenna which reduces interference with an adjacent cell and has a structure in which a high tilt angle in the directivity in the vertical plane can be obtained.

Furthermore, the present invention also provides a leaky-wave antenna capable of obtaining a high gain in which the cross polarization discrimination is 20 dB or more because such an antenna is for use in mobile communication base stations.

Solution to Problem

The present invention provides a leaky-wave antenna including CRLH transmission lines formed on a top surface of one piece of dielectric substrate that use coplanar transmission lines with a ground.

Specifically, the present invention provides a leaky-wave antenna comprising:

a dielectric substrate;

a ground surface formed on a bottom surface of the dielectric substrate; and a CRLH (Composite Right/Left Handed) transmission line including a ground unit and a transmission line unit formed on a top surface of the dielectric substrate which uses a coplanar transmission line with a ground, wherein a series capacitor constituting the CRLH transmission line is formed on a top surface of the dielectric substrate.

According to an aspect of the present invention, the series capacitor ($C_L$) includes an interdigital structure or a slot capacitor structure.

In addition, a parallel inductor ($L_L$) connected to the series capacitor ($C_L$) is formed on a top surface of the dielectric substrate.

According to another aspect of the present invention, the ground unit and one end of the parallel inductor ($L_L$) are electrically connected to the ground surface on the bottom surface of the dielectric substrate via a through-hole or a ground plate raising unit.

In addition, the present invention provides a leaky-wave antenna including CRLH transmission lines that use a coplanar transmission line with a ground, which are capable of setting off current vectors generated in a horizontal direction and a vertical direction and formed on one piece of dielectric substrate.

Specifically, the present invention is a leaky-wave antenna comprising:

a first antenna unit (A1) including one or more first unit cells (UCs); and a second antenna unit (A2) including one or more second unit cells (UC's), in which the first unit cell (UC) comprises:

a dielectric substrate;

a ground surface formed on a bottom surface of the dielectric substrate; and a first CRLH transmission line including a ground unit and a transmission line unit formed on a top surface of the dielectric substrate which uses a coplanar transmission line with a ground, in which a series capacitor ($C_L$) and a parallel inductor ($L_L$) constituting the first CRLH transmission line are formed on a top surface of the dielectric substrate, in which the second unit cell (UC') comprises:

a dielectric substrate;

a ground surface formed on a bottom surface of the dielectric substrate; and a second CRLH transmission line including a ground unit and a transmission line unit formed on a top surface of the dielectric substrate which uses a coplanar transmission line with a ground, in which a series capacitor ($C_L$) and a parallel inductor ($L_L$) constituting the second CRLH transmission line are formed on a top surface of the dielectric substrate, and in which the parallel inductor ($L_L$) connected to the series capacitor ($C_L$) of the first CRLH transmission line and the parallel inductor ($L_L$) connected to the series capacitor ($C_L$) of the second CRLH transmission line are arranged in a manner in which the parallel inductors ($L_L$) are in an axisymmetric or mirror-image positional relationship.

According to an aspect of the present invention, the series capacitor ($C_L$) includes an interdigital structure or a slot capacitor structure.

According to another aspect of the present invention, the ground unit and one end of the parallel inductor ($L_L$) are electrically connected to the ground surface on the bottom surface of the dielectric substrate via a through-hole or a ground plate raising unit.

Furthermore, the present invention provides a leaky-wave antenna including CRLH transmission lines that use a coplanar transmission line with a ground, which are capable of setting off current vectors generated in a horizontal direction and a vertical direction and formed on one piece of dielectric substrate.

Specifically, the present invention is a leaky-wave antenna including:

a first antenna set (A1, A2) comprising:

a first antenna unit (A1) which includes one or more first antenna elements; and a second antenna unit (A2) arranged in parallel to the first antenna unit in a longitudinal direction of the first antenna unit and including one or more second antenna elements; and a second antenna set (A3, A4) comprising:

a third antenna unit (A3) which includes one or more first antenna elements; and a fourth antenna unit (A4) arranged in parallel to the third antenna unit in a longitudinal direction of the third antenna unit and including one or more second antenna elements, in which:

the first antenna unit includes a first feed point (P1) on one end of the first antenna unit, the second antenna unit (A2) includes a second feed point (P2) on one end of the second antenna unit and is arranged in a manner in which the first feed point and the second feed point are located on the same end, the third antenna unit (A3) includes a third feed point on one end of the third antenna unit, the fourth antenna unit (A4) includes a fourth feed point (P4) on one end of the fourth antenna unit and is arranged in a manner in which the third feed point and the fourth feed point are located on the same end, the first antenna element comprises:

a dielectric substrate;

a ground surface formed on a bottom surface of the dielectric substrate; and a first CRLH transmission line including a ground unit and a transmission line unit formed on a top surface of the dielectric substrate which uses a coplanar transmission line with a ground, in which a series capacitor ($C_L$) and a parallel inductor ($L_L$) constituting the first CRLH transmission line are formed on a top surface of the dielectric substrate, in which the second antenna element comprises:

a dielectric substrate;

a ground surface formed on a bottom surface of the dielectric substrate;

a ground unit formed on a top surface of the dielectric substrate; and a second CRLH transmission line which is arranged adjacent to the ground unit and formed on a top surface of the dielectric substrate by using a coplanar transmission line with a ground, and in which a series capacitor ($C_L$) and a parallel inductor ($L_L$) constituting the second CRLH transmission line are formed on a top surface of the dielectric substrate, and in which the parallel inductor ($L_L$) connected to the series capacitor ($C_L$) of the first CRLH transmission line and the parallel inductor ($L_L$) connected to the series capacitor ($C_L$) of the second CRLH transmission line are arranged in a manner in which the parallel inductors ($L_L$) are in an axisymmetric or mirror-image symmetric positional relationship.

According to an aspect of the present invention, the leaky-wave antenna may include a configuration including an increased number of lines in which the number of the antenna unit is 2N (N=1, 2, . . . ) (not limited to the following configuration to be described with reference to FIG. 1, in which the leaky-wave antenna includes four lines of antenna units).

For example, according to an aspect of the present invention, in the leaky-wave antenna, three or more sets of the antenna set are arranged by further including either of the first antenna set (A1, A2) or the second antenna set (A3, A4).

In addition, according to an aspect of the present invention, the series capacitor ($C_L$) includes an interdigital structure or a slot capacitor structure.

According to another aspect of the present invention, each antenna unit constituting an odd line of each of the antenna set includes a plurality of first unit cells (UCs) connected in a longitudinal direction of the antenna unit, and each antenna unit constituting an even line of each of the antenna set includes a plurality of second unit cells (UC's) connected in a longitudinal direction of the antenna unit.

According to yet another aspect of the present invention, the ground unit and one end of the parallel inductor ($L_L$) are electrically connected to the ground surface on the bottom surface of the dielectric substrate via a through-hole or a ground plate raising unit.

In addition, the present invention also provides an antenna system including a feeding apparatus which imparts different feed phases for different feed points including the first feed point (P1), the second feed point (P2), the third feed point (P3), and the fourth feed point (P4) of the leaky-wave antenna, respectively.

The CRLH transmission line according to an embodiment of the present invention uses an interdigital capacitor as a series capacitor constituting the CRLH transmission line. Alternatively, for example, the series capacitor constituting the CRLH transmission line may be configured to be formed on a top surface of the dielectric substrate by using a slot capacitor and the like. Note that in an alternative configuration, a stub inductor may be used as the parallel inductor.

In addition, according to yet another aspect of the present invention, the CRLH transmission line according to an embodiment of the present invention may include a series capacitor including a chip capacitor and a parallel inductor including a chip inductor.

Furthermore, according to yet another aspect of the present invention, in the CRLH transmission line according to an embodiment of the present invention, the parallel inductor ($L_L$) may include a spiral inductor or a meander-line inductor so that an inductance value may vary.

Advantageous Effects of Invention

According to the present invention, the antenna includes only one piece of dielectric substrate because it uses the CRLH transmission line which uses the coplanar transmission line with a ground, and thus the present invention is capable of realizing a thin dual-polarized antenna with a simple configuration.

In addition, with respect to directivity in a horizontal plane at a targeted frequency, because the present invention includes a ground surface provided on the entire bottom surface of the dielectric substrate of the antenna element, the present invention is capable of obtaining an emission directivity suitable for sector directivity for both the vertical polarization and the horizontal polarization.

Furthermore, the present invention controls the dispersion characteristic by adjusting the parallel inductor ($L_L$) and the series capacitor ($C_L$) in the unit cells of the CRLH transmission line, and thus, the present invention is capable of obtaining a desired tilt angle.

DESCRIPTION OF EMBODIMENTS

In the following embodiment, the center frequency $f_0$ of the operation frequency band is 3.50 GHz (wavelength: $\lambda_0$), and the operation frequency band is a 40 MHz bandwidth centered at $f_0$ at 3.48 GHz to 3.52 GHz.

As will be described below, the operation frequency band can be configured variable by adjusting the values of a series capacitor $C_L$ and a parallel inductor $L_L$ and by adjusting the width of a coplanar transmission line with a ground constituting a right-handed transmission line or the gap width therefor.

(Description of the Antenna)

Figure 1:
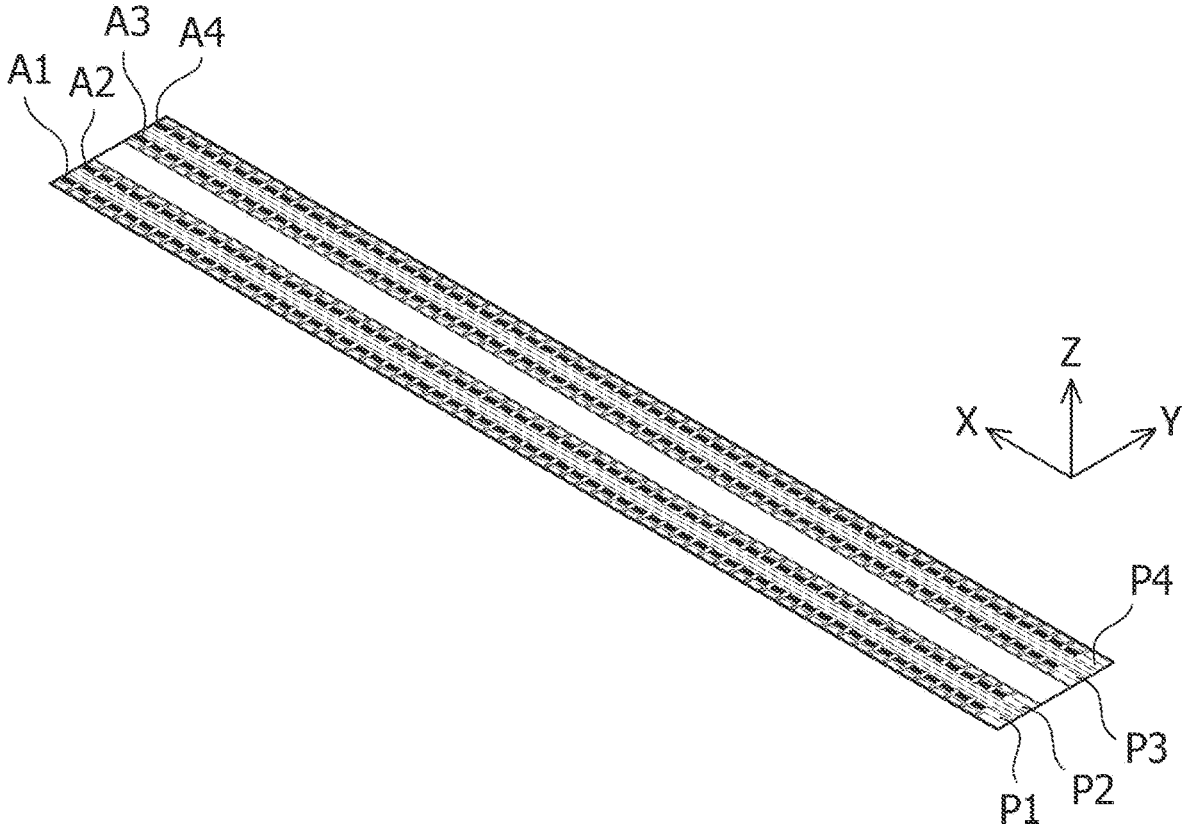
FIG. 1 is a bird's-eye view of the entire leaky-wave antenna according to an embodiment of the present invention.

Referring to FIG. 1, for the definition of each axis, the X-axis direction is a direction vertical to the ground and a YZ plane formed by the Y-axis and the Z-axis is a plane directed in a direction horizontal to the ground.

FIG. 1 shows a leaky-wave antenna according to an embodiment of the present invention. The leaky-wave antenna includes a configuration including a ground surface formed on a bottom surface of a dielectric substrate and CRLH transmission lines that use a coplanar transmission line with a ground and printed on a top surface of the dielectric substrate. In addition, a ground unit printed on a top surface of the dielectric substrate and one end of a parallel inductor ($L_L$) and a ground on the bottom surface of the substrate are electrically connected by using a via formed as a through hole or by using a conductor.

Referring to FIG. 1, the leaky-wave antenna according to an embodiment includes antenna units for the odd line (A1 and A3) and antenna units for the even line (A2 and A4). Specifically, the leaky-wave antenna shown in FIG. 1 includes a first antenna set including an antenna unit A1 for the odd line and an antenna unit A2 for the even line; and a second antenna set including an antenna unit A3 for the odd line and an antenna unit A4 for the even line. The leaky-wave antenna includes a configuration in which the arrangement of the parallel inductors constituting the CRLH transmission lines of each antenna set is such that the parallel inductors are symmetrical (in an axisymmetric or mirror-image symmetric positional relationship) with the X-axis corresponding to the longitudinal direction of each antenna unit as the axis of symmetry.

Figure 2:
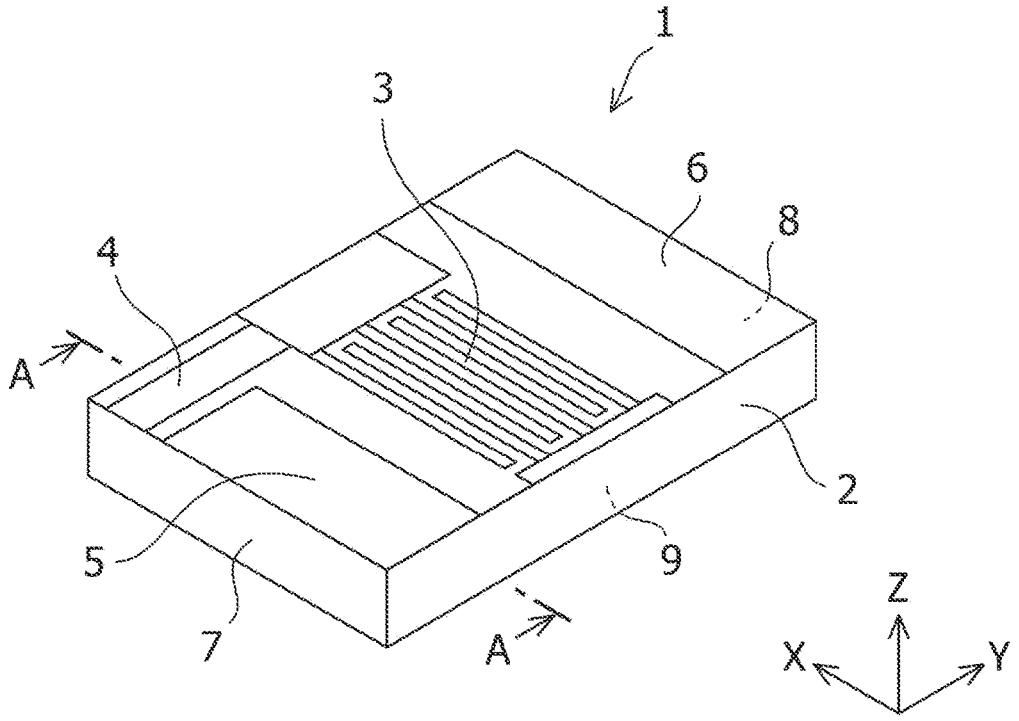
FIG. 2 is a bird's-eye view of a unit cell constituting a part of the antenna unit (A1) shown in FIG. 1.

The antenna units A1 and A3 for the odd line respectively include a configuration in which a plurality of unit cells (UCs) 1 shown in FIG. 2 is connected in the direction of X-axis corresponding to the longitudinal direction of each antenna unit. Moreover, the antenna units A2 and A4 for the even line respectively include a configuration in which a plurality of unit cells (UC's) different from the unit cell 1 shown in FIG. 2, which unit cells including a configuration in which a parallel inductor 4 is arranged axisymmetrically or mirror-image symmetrically to a series capacitor 3, is connected in the X-axis direction corresponding to the longitudinal direction of each antenna unit.

(Description of the Unit Cell)

Figure 3:
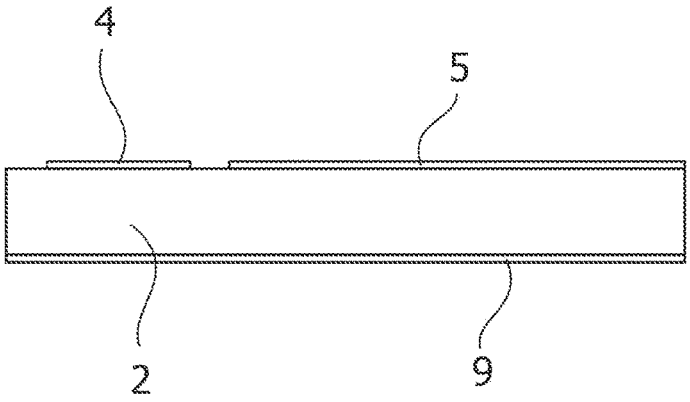
FIG. 3 is a cross section of the unit cell shown in FIG. 2 viewed from a direction A.

FIG. 2 shows an example of the unit cell (UC) 1 constituting the leaky-wave antenna according to an embodiment of the present invention. In addition, FIG. 3 is a cross section of the unit cell (UC) 1 shown in FIG. 2, sectioned at a portion shown by a solid line and viewed from a direction A. The unit cell (UC) 1 shown in FIG. 2 includes a configuration in which a CRLH transmission line including a series capacitor ($C_L$) 3 and a parallel inductor ($L_L$) 4 that are left-handed elements formed on a top surface of a dielectric substrate 2 in addition to a coplanar transmission line with a ground constituting a right-handed transmission line. In addition, the unit cell (UC) 1 includes ground units 5, 6 arranged on a top surface of the dielectric substrate 2; a ground surface 9 arranged on a bottom surface of the dielectric substrate 2; and through holes or ground plate raising units 7, 8 that electrically connect the ground units 5, 6 and the ground surface 9.

Figure 13:
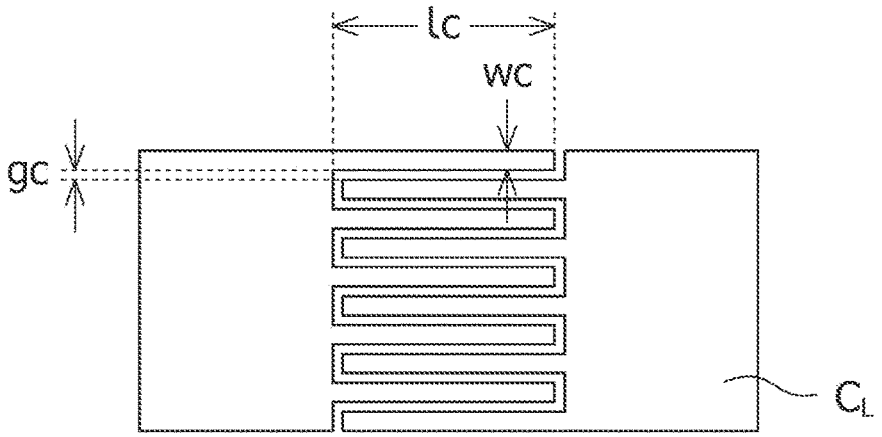
FIG. 13 is a top view showing a structure of a series capacitor 3 of the unit cell 1.

The series capacitor ($C_L$) 3 is arranged serially to the coplanar transmission line with a ground. The series capacitor ($C_L$) 3 includes an interdigital structure. Referring to FIG. 13, the capacity of the series capacitor ($C_L$) 3 can be changed to a desired value by changing a comb length 1*c*, comb width wc, and a comb gap gc of the interdigital portion having a shape of comb teeth. In other words, adjustment according to the operation frequency band and a desired dispersion characteristic can be performed by changing the capacity of the series capacitor ($C_L$) 3.

Figure 14:
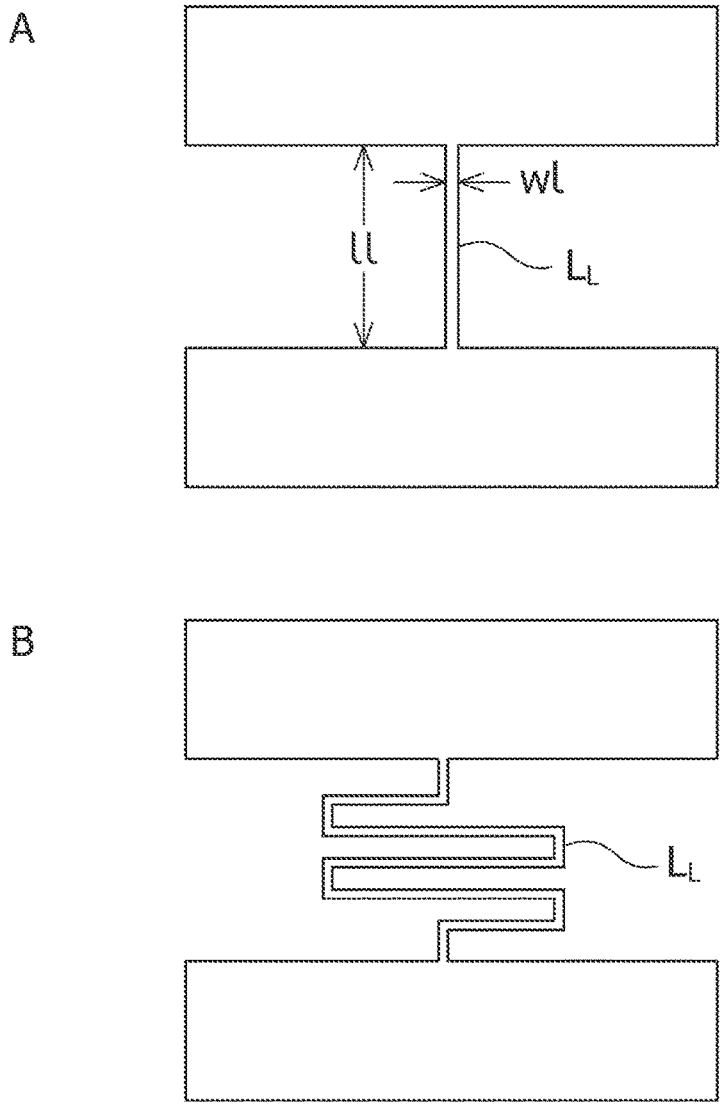
FIG. 14A is a top view showing a structure of a parallel inductor 4 of the unit cell 1.
FIG. 14B is a top view showing a structure of the parallel inductor 4 of the unit cell 1 according to another embodiment.

A conductor pattern corresponding to the parallel inductor ($L_L$) 4 has a stub structure in which one end of the parallel inductor ($L_L$) 4 is connected to the ground unit 5 and the other end is connected to the transmission line portion. In other words, the conductor pattern corresponding to the parallel inductor ($L_L$) 4 is arranged so as to connect the transmission line portion of the coplanar with a ground and the ground unit 5 of the dielectric substrate 2 via the through hole or ground plate raising unit 7. Referring to FIG. 14, FIG. 14A shows an example in which the stub of the parallel inductor ($L_L$) 4 has a linear shape, while FIG. 14B shows an example in which the stub of the parallel inductor ($L_L$) 4 has a meander shape (or a zigzag shape). As shown in FIG. 14A and FIG. 14B, an inductance value of the parallel inductor ($L_L$) 4 can be changed by changing a value of a stub width w1 and a stub length l1 of the parallel inductor ($L_L$) 4. To paraphrase this, the inductance value of the parallel inductor ($L_L$) 4 can be adjusted according to a desired operation frequency band and dispersion characteristic.

Figure 12:
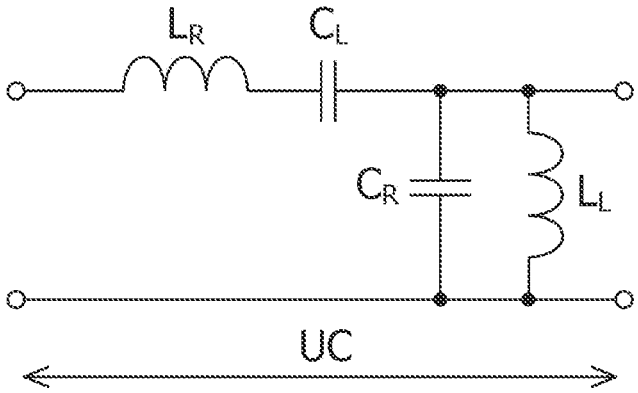
FIG. 12 is a view showing an equivalent circuit of the unit cell (UC) 1 shown in FIG. 2.

Next, FIG. 12 shows an equivalent circuit of the unit cell (UC) 1 including the CRLH transmission line shown in FIG. 2. The CRLH transmission line can be formed by a plurality of unit cell (UC) 1 connected in a specific direction. A typical transmission line, i.e., right-handed transmission line consists of an inductance element ($L_R$) and a capacitance element ($C_R$) alone. In addition to these components, the CRLH transmission line further includes left-handed series capacitance element ($C_L$) and parallel inductance element ($L_L$) in addition to the above elements. Thus, this CRLH transmission line can provide, using the four parameters $C_R$, $L_R$, $C_L$, and $L_L$, a right-handed frequency band with phase propagating forward and a left-handed frequency band with phase propagating backward.

Figure 6:
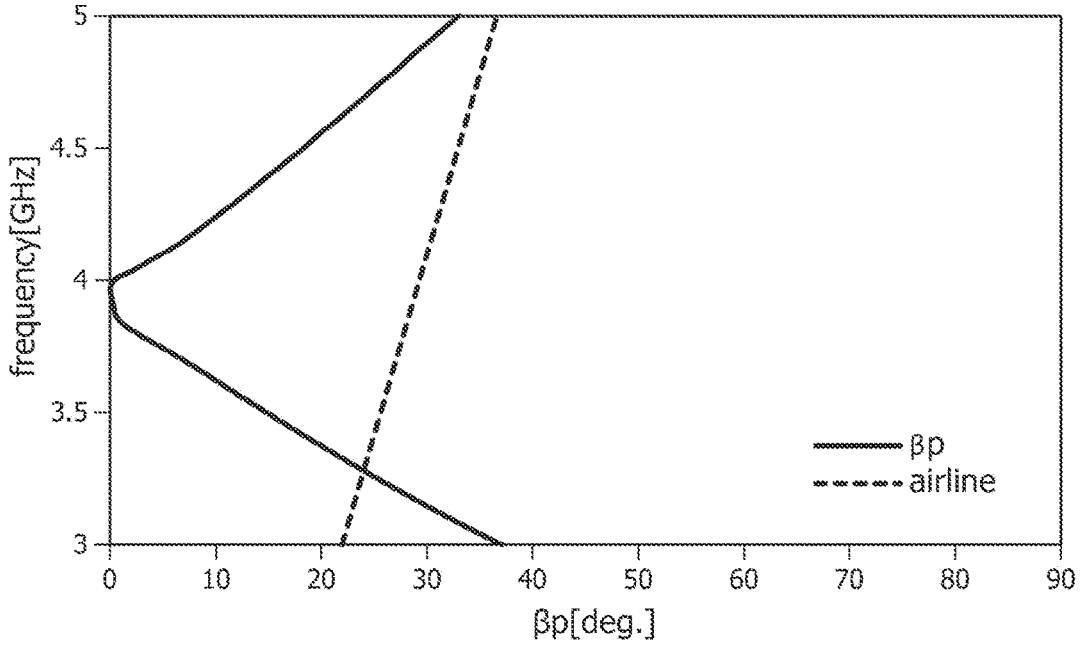
FIG. 6 is a graph showing dispersion characteristic of the unit cell.

FIG. 6 shows a dispersion characteristic of the unit cell (UC) 1 shown in FIG. 2. The dispersion characteristic denotes an amount of phase change per one unit cell. In FIG. 6, the ordinate axis represents the frequency, and the abscissa axis represents an absolute value of a phase change amount βp per one unit cell. Because the phase change amount per cell becomes greater as the value of βp becomes greater, an emission angle θ of the leaky wave obtained when multiple cells are connected becomes larger. A relationship between the emission angle θ and the phase coefficient βp of a leaky wave is expressed by the following expression.

$$\theta=\sin^{-1}(\beta/k)$$

where k stands for a wave number and β stands for a phase coefficient.

In the example shown in FIG. 6, the value of dispersion characteristic βp at the used frequency $f_0$ is 15°. In FIG. 6, a dispersion characteristic of an air line is also shown. The inside of the line indicating the air line is a fast wave band, in which leaky waves are generated from the CRLH transmission line. The term "air line" herein refers to an amount of phase change per unit cell length at a frequency $f_0$ in free space. At $f_0$, βp is on the inside of the air line, i.e., in the fast wave band. Because of this, leaky waves with the phase difference of 15° are generated from each unit cell. The unit cell length p=8 mm, and an estimate tilt angle θ becomes θ=26.5° if the used frequency $f_0$=3.5 GHz.

Note that explained above is the characteristics in the left-handed band. However, the leaky-wave antenna of the present invention is also applicable to the right-handed band in the fast wave band shown in the dispersion characteristic in FIG. 6. In this case, the antenna shows a directivity in a vertical plane that tilts upward, and also ensures emission in the X direction.

(Description of a Configuration of the Antenna)

An antenna element constituting each of the antenna units (A1 to A4) shown in FIG. 1 includes a plurality of the unit cells (UCs) 1 shown in FIG. 2 in the direction of X-axis, i.e., the longitudinal direction of each antenna unit, for example. The antenna element includes feed points P1 to P4 arranged on the bottom side and includes a line termination (open termination) arranged on a top side opposite to the bottom side. The antenna unit A1 is excited when power is fed to the feed point P1 of the antenna element (the other feed points P2 to P4 and antenna units A2 to A4 are similar).

A gain of each antenna unit A1 to A4 can be controlled by increasing and decreasing the number of unit cells to be connected. Specifically, reflection at the end of the antenna can be suppressed without installing a terminal resistance by appropriately setting the number of unit cells to be connected according to the amount of emission per one unit cell. If the number of connected unit cells is small, a terminal resistance can be installed at the end of each antenna unit. If a terminal resistance is installed, side lobe on the side of the sky can be suppressed.

In each antenna unit A1 to A4, multiple unit cells are arranged in the horizontal direction in an array. In FIG. 1, when the XY plane is viewed from the positive direction of the Z-axis, the parallel inductors of the odd-line antenna unit A1 and A3 include the unit cells (UCs) branched on the left side, while the parallel inductors of the even-line antenna unit A2 and A4 include another unit cells (UC's) branched on the right side. Specifically, to compare the odd-line antenna unit A1 and A3 and the even-line antenna unit A2 and A4, the parallel inductors of the antenna units are branched so that they are in an axisymmetric or mirror-image symmetric relationship with the X-axis corresponding to the longitudinal direction of each antenna unit as the axis of symmetry.

In FIG. 1, the example includes a configuration in which the parallel inductor of the odd-line antenna unit A1 (A3) and the parallel inductor of the even-line antenna unit A2 (A4) are branched and separated from each other outward from the CRLH transmission line. However, in another embodiment of the present invention, the parallel inductor can be branched in the reverse direction. More specifically, an alternative configuration may be employed in which the parallel inductor of the odd-line antenna unit A1 (A3) and the parallel inductor of the even-line antenna unit A2 (A4) are branched inward from the CRLH transmission line. In addition, the directivity in the horizontal plane can be controlled by increasing the number of antenna units to be arranged.

Note that in order to suppress cross polarization, it is preferable if, using the X-axis corresponding to the longitudinal direction of each antenna unit (A1 to A4) as the axis of symmetry, the direction of branching of the parallel inductor ($L_L$) from the transmission line be the Y-axis negative direction for the odd line and the Y-axis positive direction for the even line.

According to the leaky-wave antenna of the present invention, two antenna sets including a combination of the odd-line antenna unit (A1, A3) and another combination of the even-line antenna unit (A2, A4) are arranged, and thus, generation of cross polarization in the horizontal plane can be suppressed. As another method of controlling the directivity in the horizontal plane, the directivity in the horizontal plane can be controlled by arranging a metal reflecting plate on the side of the bottom surface of each antenna unit (A1 to A4).

(Switching of the Polarization by Switching the Power Feed Method)

Figure 4:
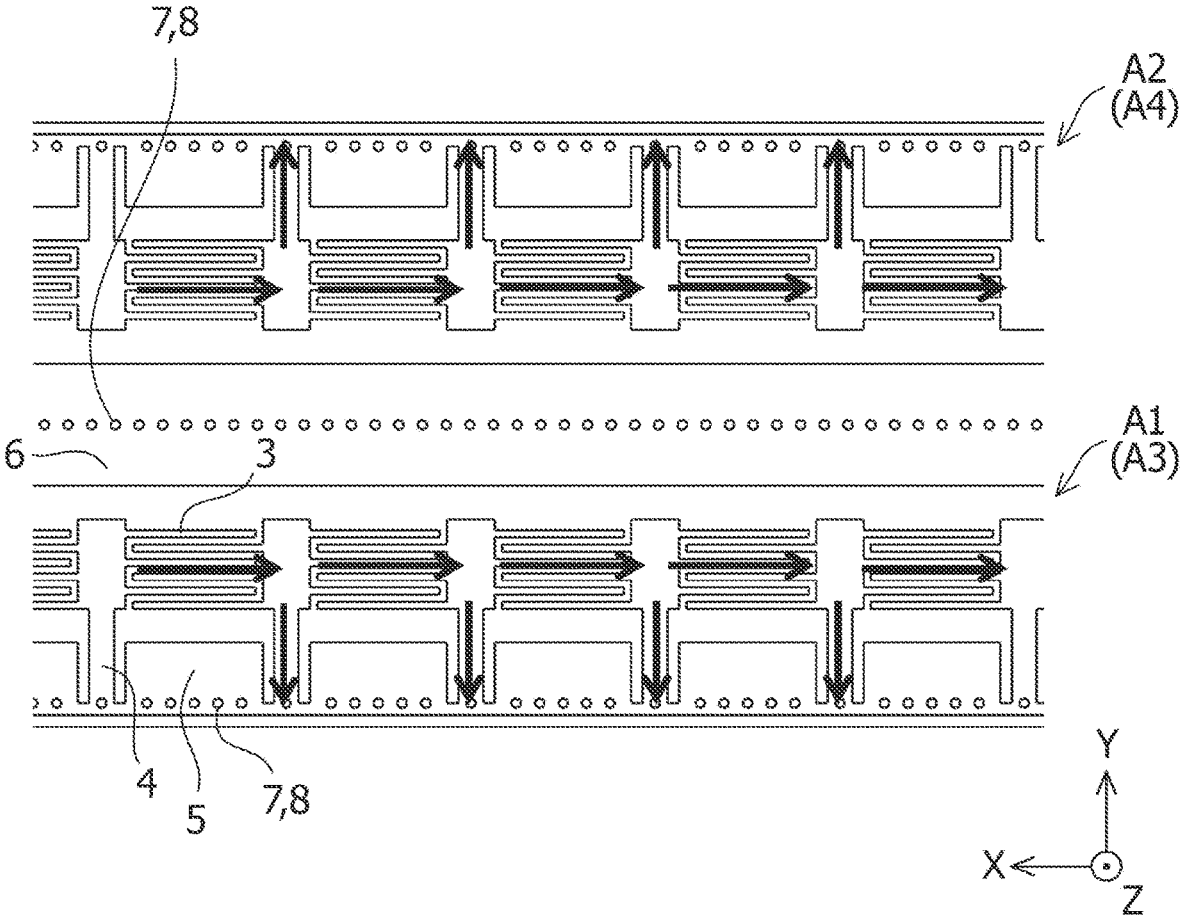
FIG. 4 is a plan view showing distribution of current obtained when the inphase is input to the feed points P1 and P2.
Figure 5:
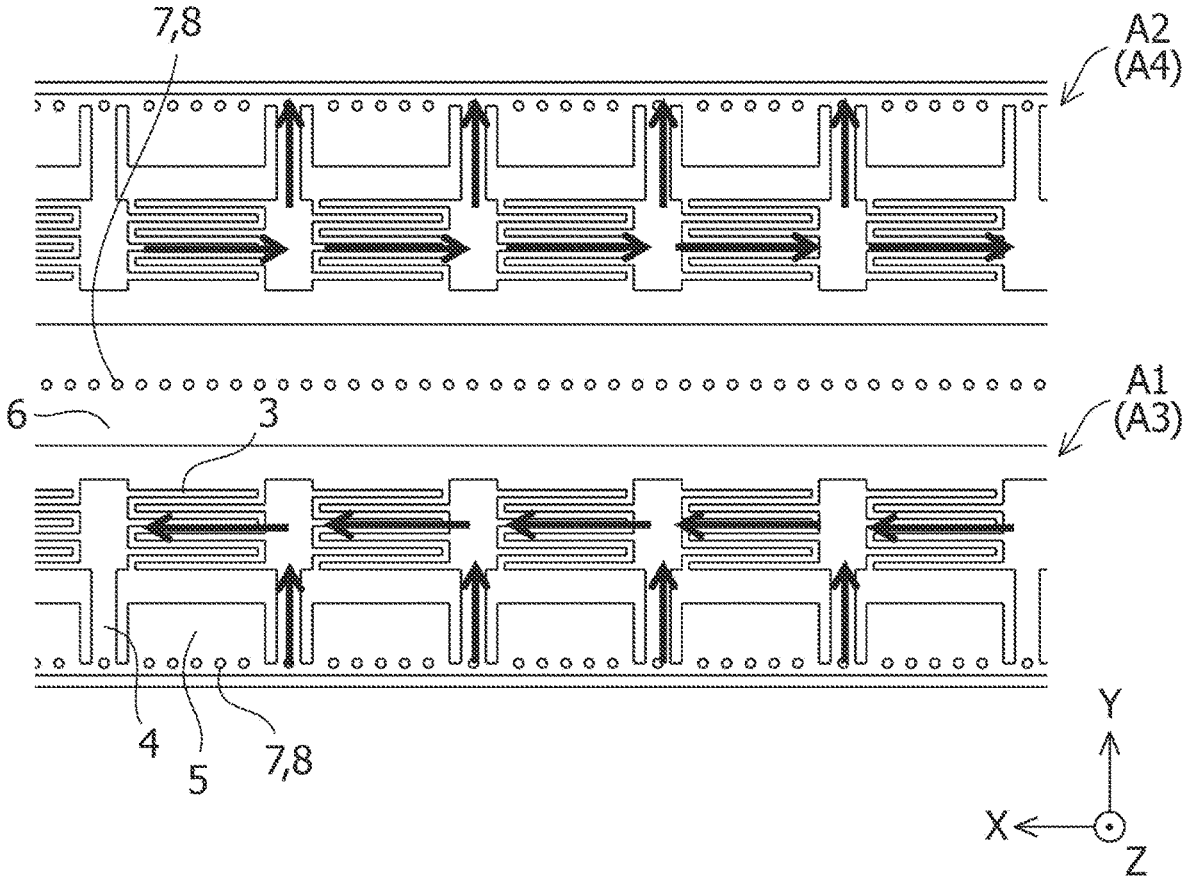
FIG. 5 is a plan view showing distribution of current obtained when the opposite phases are input to the feed points P1 and P2.

FIG. 4 and FIG. 5 respectively show polarizations (vertical polarizations and horizontal polarizations) of the dual-polarized leaky-wave antenna which uses a CRLH transmission line including coplanar transmission lines with a ground. In the dual-polarized leaky-wave antenna, if the phase of feeding to the pair of CRLH transmission lines is changed, dual polarization can be performed by generating multiple linear polarizations, by changing the polarizations to be used, and by simultaneously exciting different polarizations. FIG. 4 shows distribution of current obtained when the vertical polarization is excited by the antenna unit A1 (A3) constituting the odd-line antenna unit and the antenna unit A2 (A4) constituting the even-line antenna unit. If the inphase is fed to the CRLH transmission lines of the antenna unit A1 (A3) and the antenna unit A2 (A4), the series capacitor unit generates current vectors in the same direction in the X-axis direction that is the direction vertical to the ground for the antenna unit A1 (A3) and the antenna unit A2 (A4). In contrast, the parallel inductor unit generates reverse current vectors in the opposite directions in the Y-axis direction that is the direction horizontal to the ground for the antenna unit A1 (A3) and the antenna unit A2 (A4). Accordingly, the current vectors in the X-axis direction are intensified because they are in the same direction, while the current vectors in the Y-axis direction are set off because they are in the opposite directions. Thus the current in the X-axis direction becomes dominant and excites the vertical polarization.

FIG. 5 shows distribution of current obtained when the horizontal polarization is excited by the antenna unit A1 (A3) constituting the odd-line antenna unit and the antenna unit A2 (A4) constituting the even-line antenna unit. By feeding the CRLH transmission lines of the antenna unit A1 (A3) and antenna unit A2 (A4) in 180° opposite phases, the series capacitor unit generates current vectors in the X-axis direction in directions opposite between the antenna unit A1 (A3) and the antenna unit A2 (A4). Moreover, the parallel inductor unit generates current vectors in the Y-axis direction in the same direction for the antenna unit A1 (A3) and antenna unit A2 (A4). In this case, the current vector in the X-axis direction is set off, the current vector in the Y-axis direction becomes dominant, and the horizontal polarization is excited.

Figure 7:
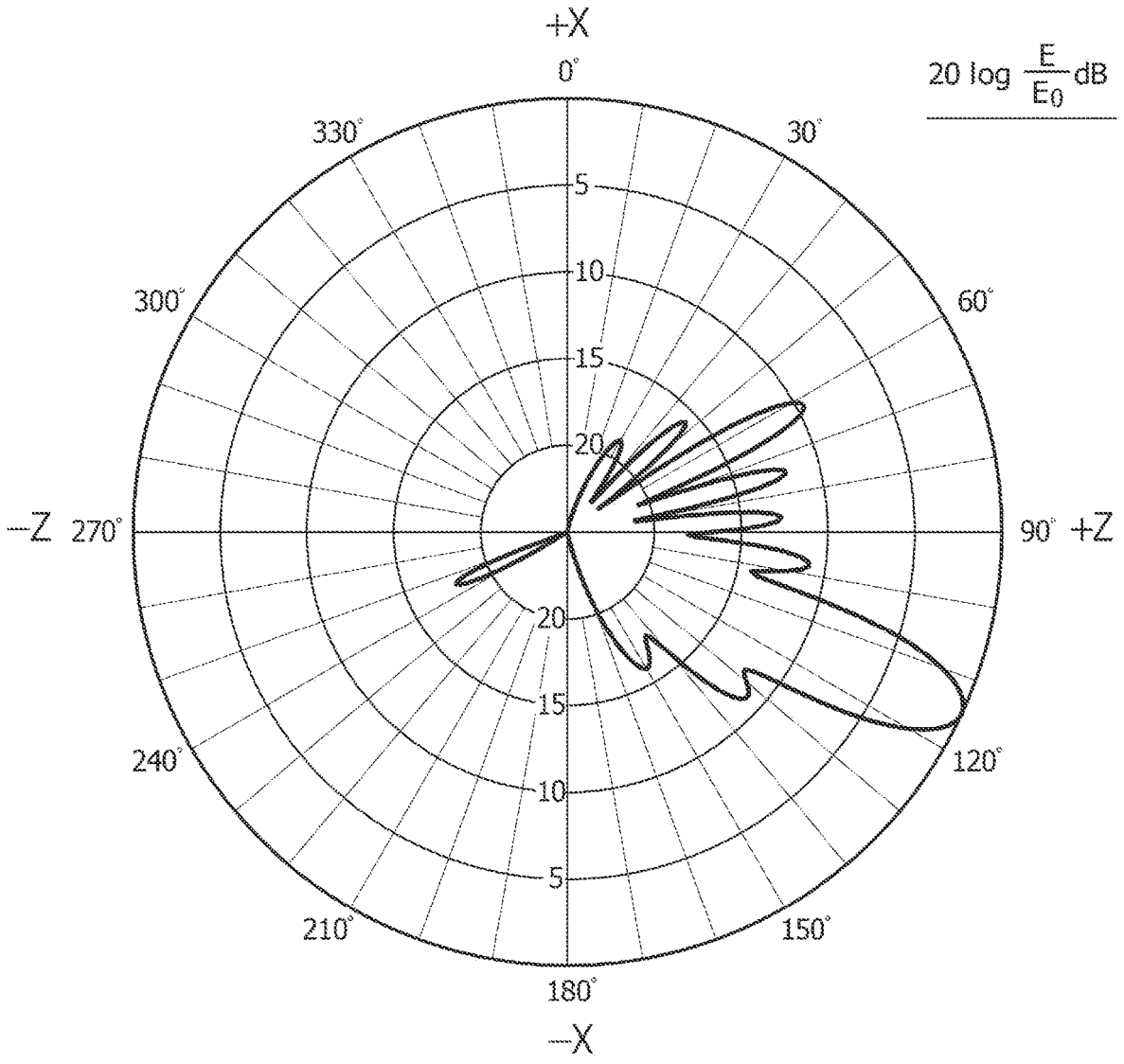
FIG. 7 is a graph showing emission directivity of a vertical polarization in directivity in the vertical plane.
Figure 8:
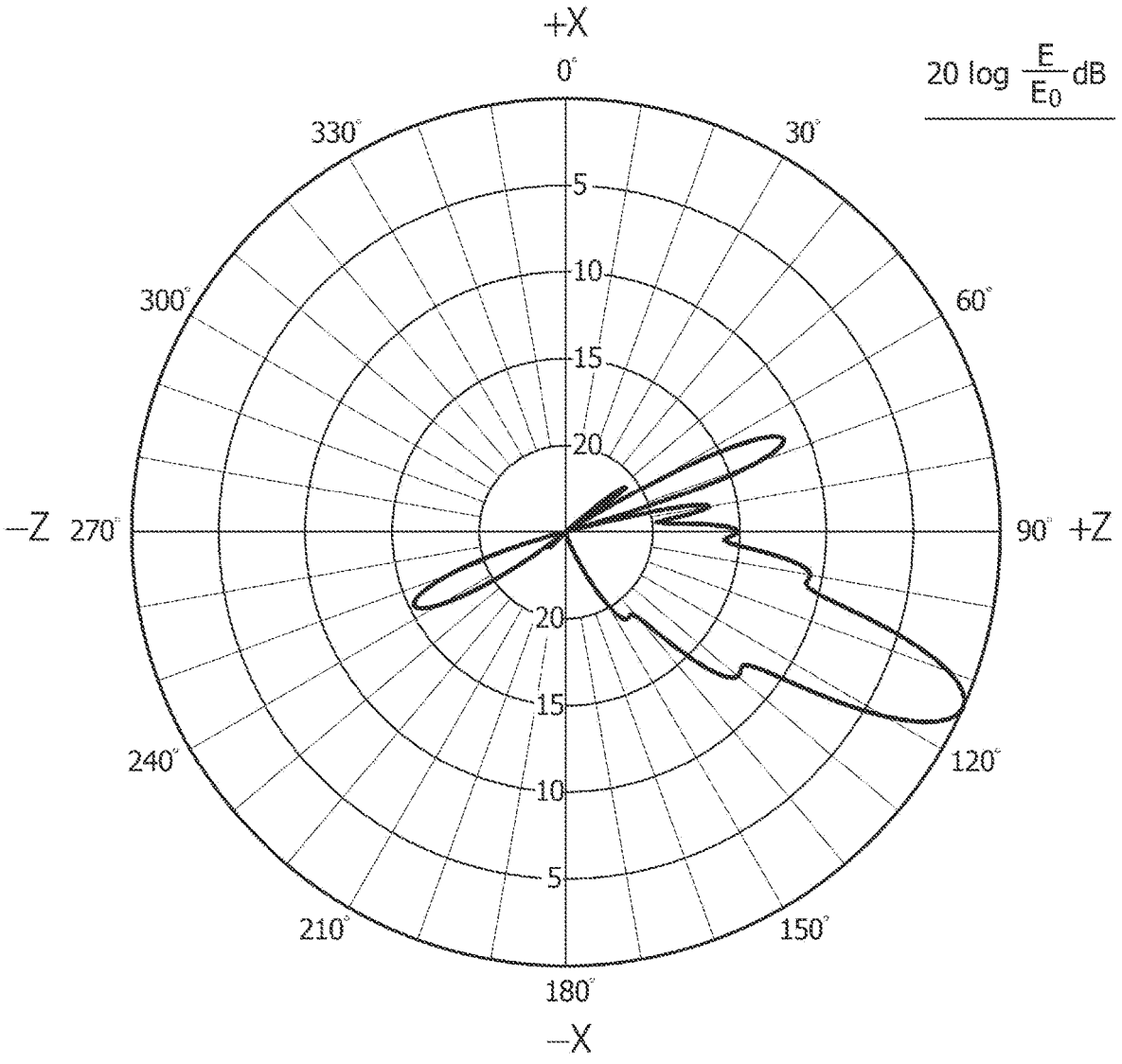
FIG. 8 is a graph showing the emission directivity of a horizontal polarization in directivity in the vertical plane.

FIG. 7 shows directivity in the vertical plane if the same-phase current is fed to the feed points P1 to P4 (vertical polarization excitation) at a normalized frequency of 1. FIG. 8 shows directivity in the vertical plane if currents are fed to the feed points P1 and P3 with a phase difference of 180° from the phase of the currents fed to the feed points P2 and P4 (horizontal polarization excitation) at a normalized frequency of 1. It is verified from these graphs that a vertical plane tilt angle is almost equivalent to an estimated tilt angle θ calculated from the dispersion characteristic.

Figure 9:
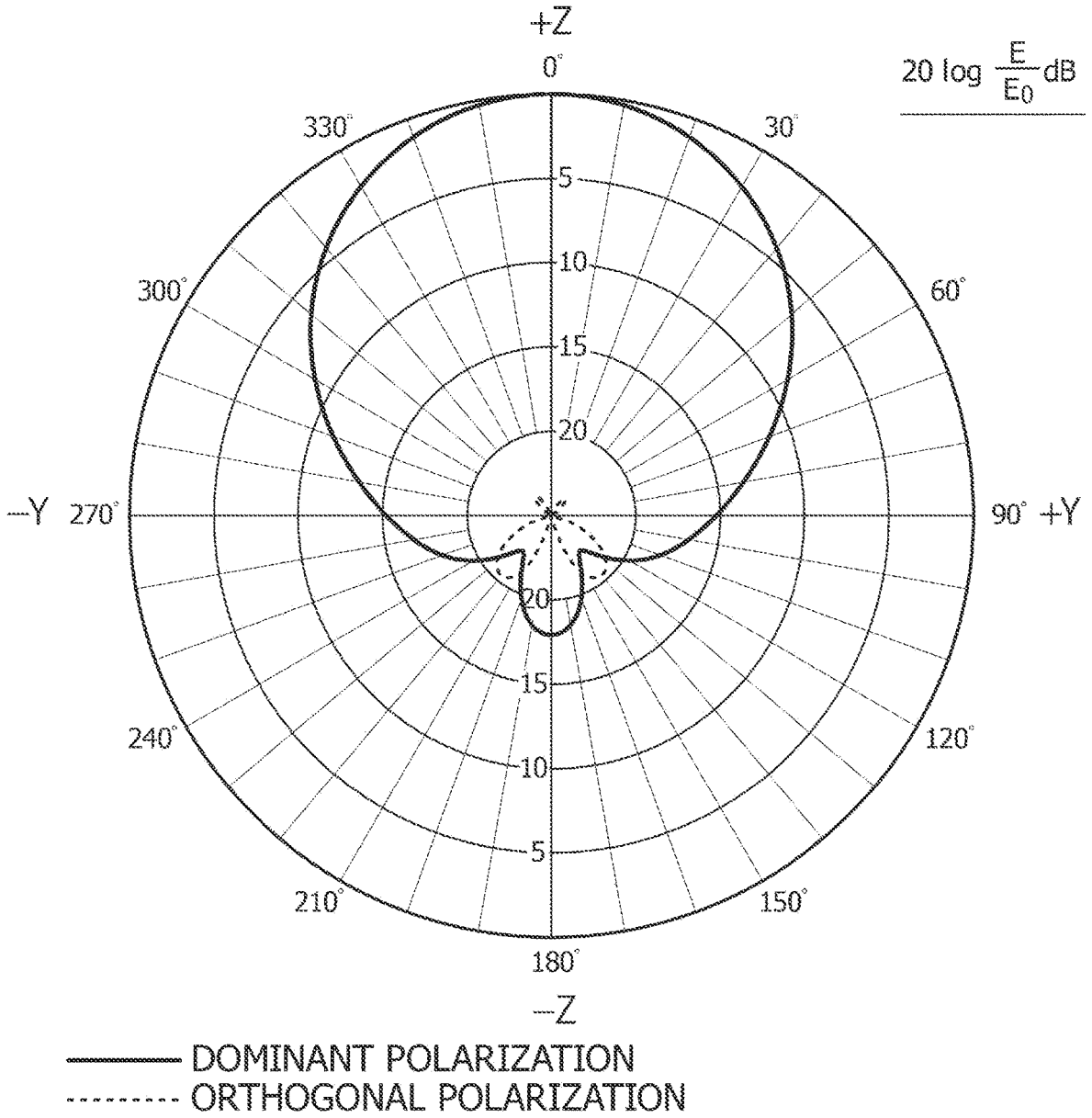
FIG. 9 is a graph showing emission directivity of a vertical polarization in directivity in the horizontal plane.
Figure 10:
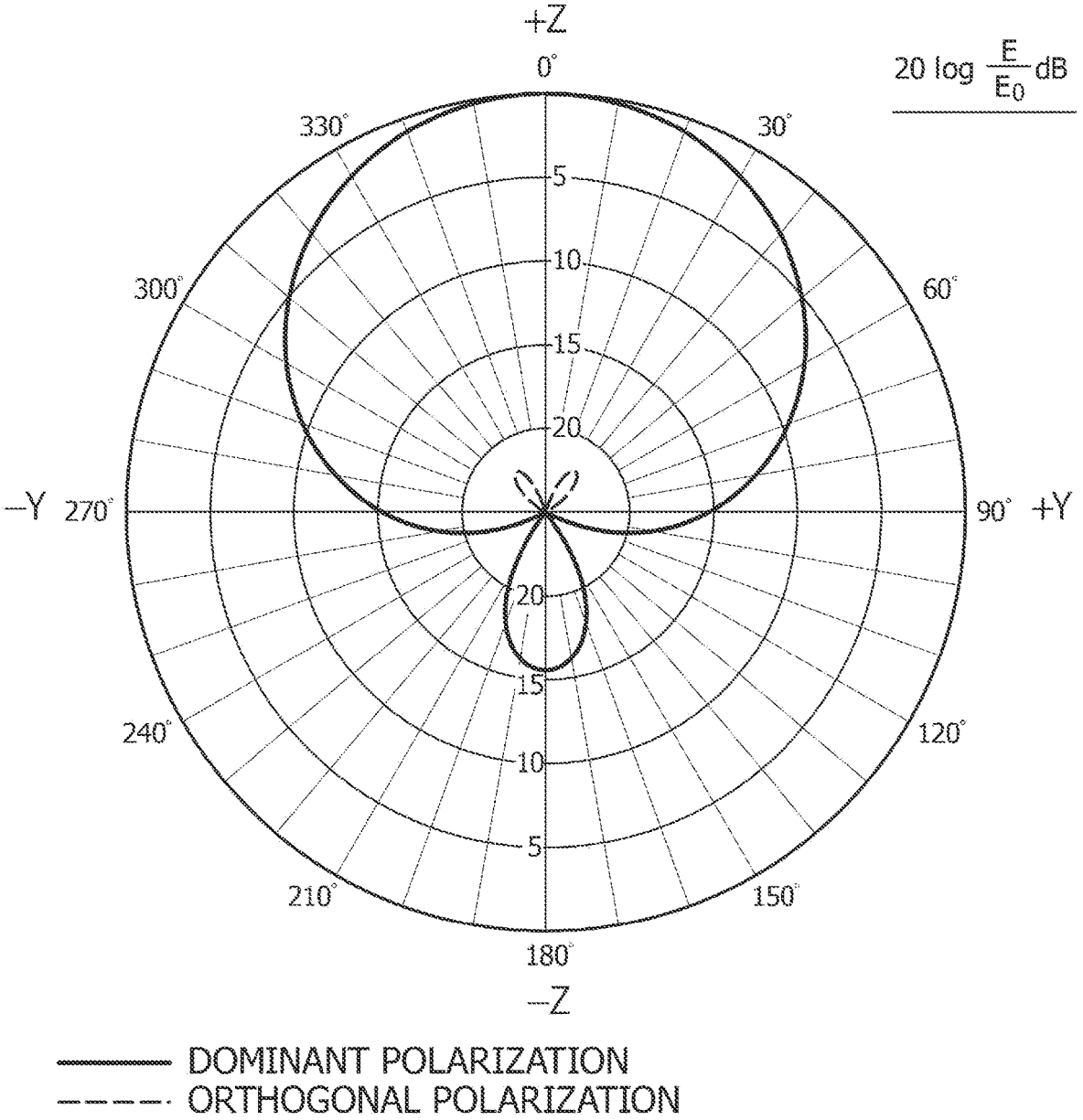
FIG. 10 is a graph showing the emission directivity of a horizontal polarization in directivity in the horizontal plane.

FIG. 9 shows directivity in the horizontal plane if the same-phase current is fed to the feed points P1 to P4 (vertical polarization excitation) at a normalized frequency of 1. FIG. 10 shows directivity in the horizontal plane if currents are fed to the feed points P1 and P3 with a phase difference of 180° from the phase of the currents fed to the feed points P2 and P4 (horizontal polarization excitation) at a normalized frequency of 1. The directivity in the horizontal plane is a directivity at the largest angle in the directivity in the vertical plane. It is understood from these graphs that almost the same half-value angle in the horizontal plane is obtained for the vertical polarization and the horizontal polarization.

In addition, FIG. 9 and FIG. 10 also show a directivity of the dominant polarization and a directivity of the orthogonal polarization. The leaky-wave antenna according to an embodiment of the present invention includes the antenna units (A1 to A4) for four lines, and it is thereby made possible to secure 20 dB or more of XPD (cross polarization discrimination) for both the vertical polarization and the horizontal polarization.

Figure 11:
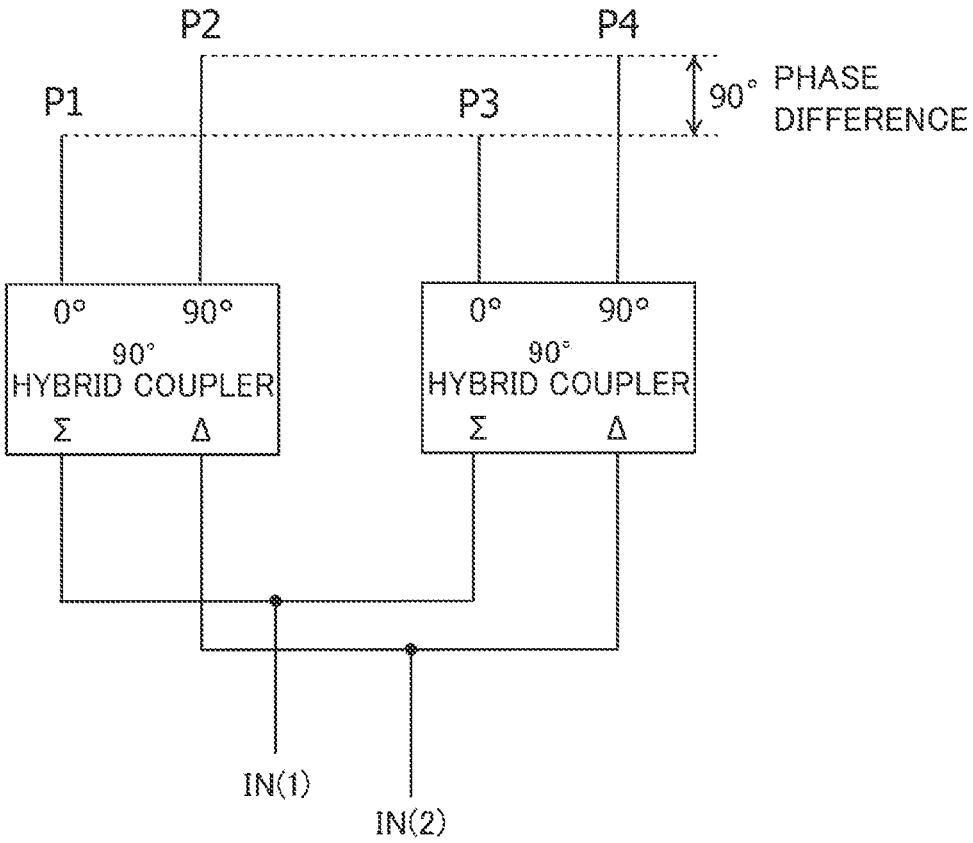
FIG. 11 is a circuit structure diagram showing a feeding apparatus which imparts different feed phases for different feed points (P1 to P4) of each antenna unit (A1 to A4).

FIG. 11 shows a feeding apparatus used in a case of operating the leaky-wave antenna (A1 to A4) according to an embodiment of the present invention as a polarization antenna. FIG. 11 shows an embodiment which uses two hybrid couplers as the feeding apparatus. Each of the hybrid couplers shown in FIG. 11, if a signal is input from a Σ-bond input port, outputs the input signal (IN (1)) as the same-phase signal from output ports connected to the feed points P1 and P3 of the odd-line antenna units A1 (A3). In addition, each of the hybrid couplers shown in FIG. 11, if a signal is input from a A-bond input port, outputs the input signal (IN (2)) as the opposite-phase signal from output ports connected to the feed points P2 and P4 of the even-line antenna units A2 (A4).

As described above, by inputting a desired input signal (IN (1), IN (2)) to the hybrid coupler shown in FIG. 11, the leaky-wave antenna (A1 to A4) according to the above-described embodiment can be operated as a polarization antenna.

REFERENCE SIGNS LIST

1 unit cell
2 dielectric substrate
3 series capacitor ($C_L$)
4 parallel inductor ($L_L$)
5, 6 ground unit
7, 8 through hole or ground plate raising unit
9 ground surface
A1 to A4 antenna
P1 to P4 feed point

The invention claimed is:

1. A leaky-wave antenna comprising:

a first antenna set comprising:

a first antenna unit which comprises one or more first antenna elements; and a second antenna unit arranged in parallel to the first antenna unit in a longitudinal direction of the first antenna unit and including one or more second antenna elements; and a second antenna set comprising:

a third antenna unit which comprises one or more first antenna elements; and a fourth antenna unit arranged in parallel to the third antenna unit in a longitudinal direction of the third antenna unit and including one or more second antenna elements, wherein the first antenna set and the second antenna set are arranged in a horizontal direction perpendicular to the longitudinal direction of each antenna unit, and wherein the first antenna unit comprises a first feed point on one end of the first antenna unit, the second antenna unit comprises a second feed point on one end of the second antenna unit and is arranged in a manner in which the first feed point and the second feed point are located on the same end, the third antenna unit comprises a third feed point on one end of the third antenna unit, and the fourth antenna unit comprises a fourth feed point on one end of the fourth antenna unit and is arranged in a manner in which the third feed point and the fourth feed point are located on the same end, wherein the first antenna element comprises:

a dielectric substrate;

a ground surface formed on a bottom surface of the dielectric substrate; and a first CRLH transmission line including a ground unit and a transmission line unit formed on a top surface of the dielectric substrate which uses a coplanar transmission line with a ground, wherein a series capacitor and a parallel inductor constituting the first CRLH transmission line are formed on a top surface of the dielectric substrate, wherein the second antenna element includes:

a dielectric substrate;

a ground surface formed on a bottom surface of the dielectric substrate;

a ground unit formed on a top surface of the dielectric substrate; and a second CRLH transmission line comprising a ground unit and a transmission line unit formed on a top surface of the dielectric substrate which uses a coplanar transmission line with a ground, wherein a series capacitor and a parallel inductor constituting the second CRLH transmission line are formed on a top surface of the dielectric substrate, and wherein the parallel inductor connected to the series capacitor of the first CRLH transmission line and the parallel inductor connected to the series capacitor of the second CRLH transmission line are arranged in a manner in which the parallel inductors are in an axi-symmetric or mirror-image symmetric positional relationship.

2. The leaky-wave antenna according to claim 1, wherein three or more sets of the antenna set are arranged in the horizontal direction by further including either of the first antenna set or the second antenna set.

3. The leaky-wave antenna according to claim 1, wherein the series capacitor includes an interdigital structure or a slot capacitor structure.

4. The leaky-wave antenna according to claim 1, wherein each antenna unit constituting an odd line of each of the antenna set comprises a plurality of first unit cells connected in a longitudinal direction of the antenna unit, and each antenna unit constituting an even line of each of the antenna set comprises a plurality of second unit cells connected in a longitudinal direction of the antenna unit.

5. The leaky-wave antenna according to claim 1, wherein the ground unit and one end of the parallel inductor are electrically connected to the ground surface on a bottom surface of the dielectric substrate via a through-hole or a ground plate raising unit.

6. An antenna system comprising:

the leaky-wave antenna according to claim 1; and a feeding apparatus which imparts feeding phases that are opposite between the first and the second feed points and the third and the fourth feed points.

* * * * *